United States Patent [19]

Tachibana et al.

[11] Patent Number: 4,891,871

[45] Date of Patent: Jan. 9, 1990

[54] HEDDLE TRANSFERRING APPARATUS

[75] Inventors: Juro Tachibana, Matsuyama; Yoshihide Nishimura, Iyo, both of Japan

[73] Assignee: Teijin Seiki Company Limited, Osaka, Japan

[21] Appl. No.: 216,491

[22] Filed: Jul. 8, 1988

[30] Foreign Application Priority Data

Jul. 10, 1987 [JP] Japan ..... 62-172350

[51] Int. Cl.[4] ..... D03J 1/14

[52] U.S. Cl. ..... 28/205; 28/206

[58] Field of Search ..... 28/205, 206, 207

[56] References Cited

U.S. PATENT DOCUMENTS 4,723,346 2/1988 Tachibana et al. ..... 28/206

FOREIGN PATENT DOCUMENTS 348937 10/1960 Switzerland .

593660 10/1947 United Kingdom .

*Primary Examiner*—Werner H. Schroeder

*Assistant Examiner*—Jodi Tokar

*Attorney, Agent, or Firm*—Cushman, Darby & Cushman

[57] ABSTRACT

A heddle transferring apparatus comprising: a heddle magazine having upper and lower magazine bars which have a plurality of heddles supported thereon; a heddle bar supporting rack having a plurality of upper and lower heddle bars supported thereon; means for separating one heddle from among the plurality of heddles and maintaining the separated heddle in a first predetermined position; a pair of heddle transferring chucks for transferring to a second predetermined position the heddle maintained in the first predetermined position; a pair of heddle receiving hooks for receiving the heddle transferred to the second predetermined position from the pair of heddle transferring chucks; a pair of heddle retaining bars for retaining the heddle of the second predetermined position in cooperation with the heddle receiving hooks; and a pair of heddle pushing bars for inserting the heddle received on the heddle receiving hooks on predetermined upper and lower heddle bars of the upper and lower heddle bars.

2 Claims, 11 Drawing Sheets

HEDDLE TRANSFERRING APPARATUS

FIELD OF THE INVENTION

The present invention relates in general to a heddle transferring apparatus, and in particular to a heddle transferring apparatus for transferring a heddle one by one to a predetermined heddle bar from a heddle magazine of a warp-threading apparatus.

DESCRIPTION OF THE PRIOR ART

A warp-threading apparatus is normally provided with a heddle transferring apparatus for transferring a heddle with a warp thread passed therethrough to a predetermined position. In a generally known heddle transferring apparatus, a heddle is separated from among a plurality of heddles which are supported on one end portions of upper and lower heddle supporting bars, and a warp thread is passed through the separated heddle. Thereafter, the heddle with the warp thread passed therethrough is transferred to the other end portions of the upper and lower heddle supporting bars. In this type, a plurality of heddle supporting bars are disposed in a direction perpendicular to a warp-threading direction, nd a drive mechanism of a warp-threading hook and a plurality of warp threads unwound from a warp beam are disposed in opposed relationship to the heddle supporting bars. For this reason, a stroke of the threading is increased and thus the warp-threading hook becomes longer. Further, as the hook is thin so that it can pass through an eye of the heddle, the rigidity of the hook is necessarily reduced if the hook becomes longer. As a result, the conventional heddle transferring apparatus has the drawback that the warp thread frequently fails to pass through the heddle eye.

In order to overcome the drawback, there are two types wherein a warp-threading hook is relatively short. In one type, a heddle bar transferring apparatus is provided to transfer to a predetermined position a heddle supporting bar which has supported thereon a heddle with a warp thread passed therethrough. In another type, there are provided a warp-drawing hook movable in a direction perpendicular to a heddle supporting bar and a warp-threading hook movable in a direction parallel to the heddle supporting bar. With the heddle supporting bar fixed, a heddle is transferred by a heddle transferring apparatus, and then a warp thread drawn by the warp-drawing hook is passed through the heddle by the warp-threading hook. This type can make the warp-threading hook shorter and overcome the aforementioned drawback as the warp-threading hook and the drive mechanism can be moved close to the heddle which is moved and transferred in the direction perpendicular to the heddle supporting bar, without modifying the function of the heddle transferring apparatus. However, in the heddle transferring apparatuses of the aforementioned two types, there is another drawback that the apparatus is structurally complex and the moving members are heavy as the drive mechanism of the heddle supporting bar and the warp-threading hook are moved.

Accordingly, it is an object of the present invention to provide an improved heddle transferring apparatus which overcomes all of the drawbacks of the conventional heddle transferring apparatuses.

SUMMARY OF THE INVENTION

The foregoing object is accomplished in accordance with the present invention by providing a heddle transferring apparatus comprising: a heddle magazine having upper and lower magazine bars which have a plurality of heddles supported thereon; a heddle bar supporting rack disposed in spaced and opposed relationship to the heddle magazine and having supported thereon a plurality of upper heddle bars in opposed relationship to the upper magazine bar and a plurality of lower heddle bars in opposed relationship to the lower magazine bar; means for separating one heddle from among the plurality of heddles and maintaining the separated heddle in a first predetermined position wherein a warp thread is passed through the heddle; a pair of upper and lower heddle transferring chucks for transferring to a second predetermined position the heddle maintained in the first predetermined position; a pair of upper and lower heddle receiving hooks for receiving the heddle transferred to the second predetermined position from the pair of heddle transferring chucks, each of the heddle receiving hooks being movable in a direction parallel to a warp-threading direction wherein a warp thread is passed through the heddle so as to be selectively stopped on an extension line of predetermined upper and lower heddle bars of the upper and lower heddle bars; a pair of upper and lower heddle retaining bars for retaining the heddle of the second predetermined position in cooperation with the heddle receiving hooks, each of the heddle retaining bars being disposed parallel to the warp-threading direction and in opposed relationship to the corresponding heddle receiving hook and being movable along a vertical plane perpendicular to the warp-threading direction; and a pair of upper and lower heddle pushing bars each disposed parallel to the warp-threading direction and in opposed relationship to the corresponding heddle receiving hook and each movable along the vertical plane perpendicular to the warp-threading direction so that the heddle received on the heddle receiving hooks is inserted on the predetermined upper and lower heddle bars.

BRIEF DESCRIPTION OF THE DRAWINGS

The features and advantages of a heddle transferring apparatus according to the present invention will be more clearly understood from the following description taken in conjunction with the accompanying drawings.

DESCRIPTION OF THE PREFERRED EMBODIMENTS

Figure 1:
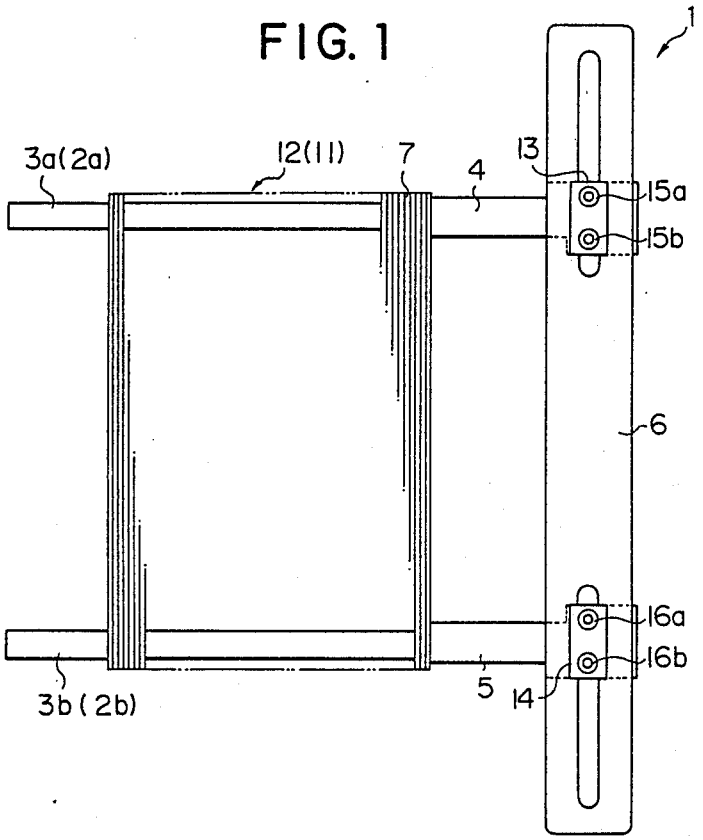
FIG. 1 is a side elevational view showing a heddle magazine of the heddle transferring apparatus according to the present invention.
Figure 2:
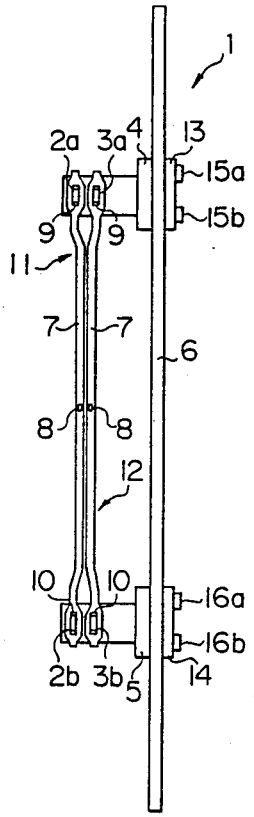
FIG. 2 is a front elevational view of the heddle magazine shown in FIG. 1.
Figure 3:
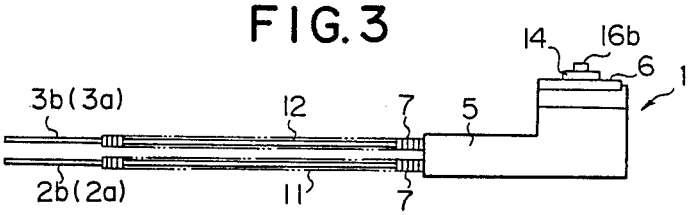
FIG. 3 is a bottom plan view of the heddle magazine shown in FIG. 1.

Referring now in greater detail to the drawings and initially to FIGS. 1, 2 and 3, there is shown a heddle magazine generally designated by reference numeral 1. The heddle magazine 1 comprises a pair of first magazine bars consisting of vertically spaced upper and lower magazine bars 2*a* and 2*b*, and a pair of second magazine bars disposed in parallel relationship to the first magazine bars and consisting of vertically spaced upper and lower magazine bars 3*a* and 3*b*. The heddle magazine 1 further comprises an upper supporting bracket 4 to which the upper magazine bar 2*a* of the first magazine bars and the upper magazine bar 3*a* of the second magazine bars are fixed, a lower supporting bracket 5 to which the lower magazine bar 2*b* of the first magazine bars and the lower magazine bar 3*b* of the second magazine bars are fixed, and a stationary magazine support 6 having the upper and lower supporting brackets 4 and 5 supported thereon. As shown in FIG. 2, a heddle 7 is in the form of a vertically extending thin plate and formed at its central portion with an eye 8 and at its upper and lower end portions with guide apertures 9 and 10. A mass of the heddles 7 are carried through the guide apertures 9 and 10 thereof on the first magazine bars 2*a* and 2*b*, and form a first heddle group 11. Likewise, a mass of the heddles 7 are carried through the guide apertures 9 and 10 thereof on the second magazine bars 3*a* and 3*b*, and form a second heddle group 12. The aforesaid upper and lower supporting brackets 4 and 5 are respectively fixed through washers 13 and 14 to the stationary magazine support 6 by means of upper bolts 15*a*, 15*b* and lower bolts 16*a*, 16*b*.

Figure 4:
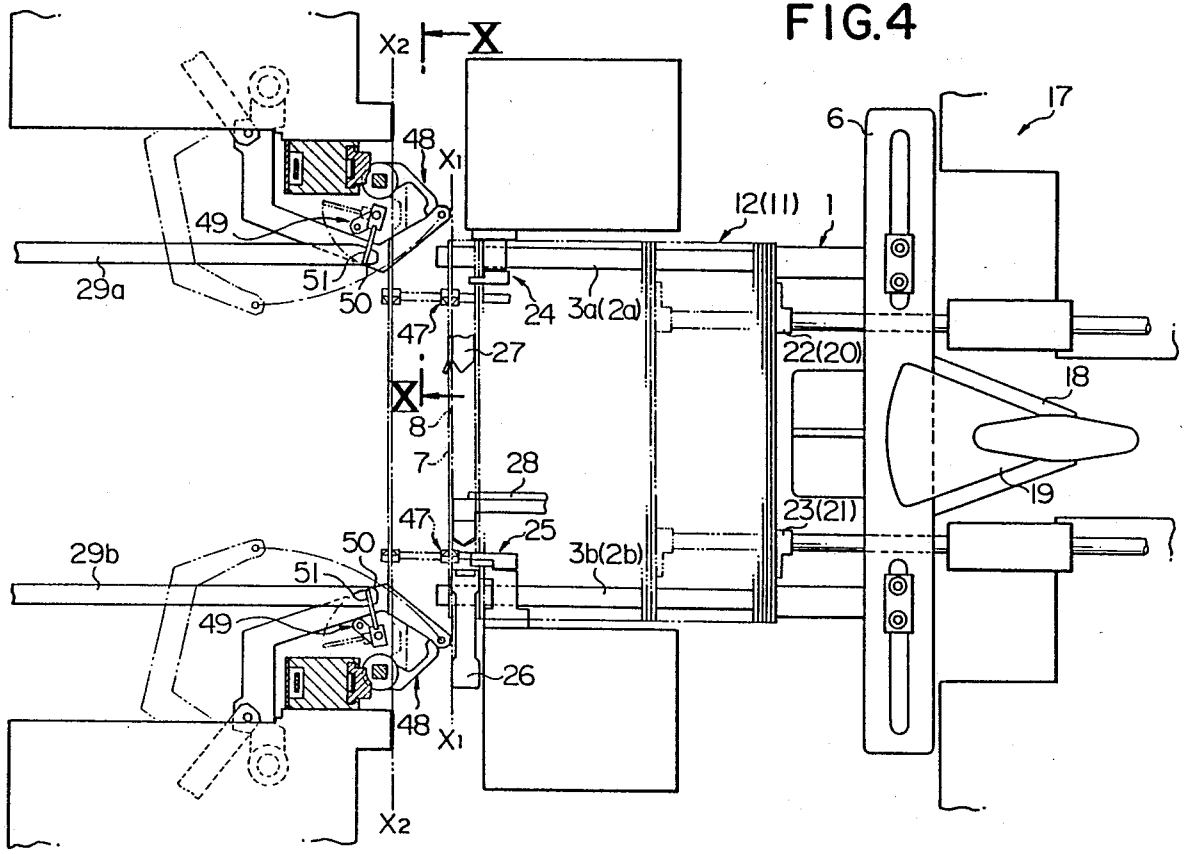
FIG. 4 is a side elevational view, partly broken away, showing the overall construction of the heddle transferring apparatus according to the present invention.

In FIG. 4, the stationary magazine support 6 is stationarily held by a bracket 18 and a fan-type lever 19, which are mounted on a stationary frame member 17 of a warp-threading apparatus (not shown), and thus the heddle magazine 1 is stationarily mounted on the stationary frame member 17. A first heddle advancing members 20 and 21 and a second heddle advancing members 22 and 23 are provided to advance the first and second heddle groups 11 and 12 toward a warp-threading position $X_1$—$X_1$ shown in FIG. 4, respectively. When the heddle advancing members 20, 21, 22 and 23 are respectively advanced toward the position $X_1$—$X_1$ by actuators (not shown), the members 20 and 21 are brought into engagement with the first heddle group 11 supported by the heddle magazine 1 and cause the first heddle group 11 to advance toward the warp-threading position $X_1$—$X_1$ Also, the members 22 and 23 are brought into engagement with the second heddle group 12 and cause the second heddle group 12 to advance toward the position $X_1$—$X_1$. The movements of the upper end portions of the first and second heddle groups 11 and 12 are limited by an upper heddle stop means 24, while the movements of the lower end portions of the first and second heddle groups 11 and 12 are limited by a lower heddle stop means 25. When the heddles are released by the upper and lower heddle stop means 24 and 25, the heddle 7 is removed one by one selectively from the first or second heddle group 11 or 12 by means of a heddle removing mechanism 26. The upper end portion of the separated heddle 7 is moved and maintained in the position $X_1$—$X_1$ by upper heddle positioning means 27, while the lower end portion of the separated heddle is moved and maintained in the position $X_1$—$X_1$ by lower heddle positioning means 28. A warp thread is then passed through the eye 8 of the heddle 7 maintained in the position $X_1$—$X_1$ by the warp-threading apparatus (not shown).

Figure 5:
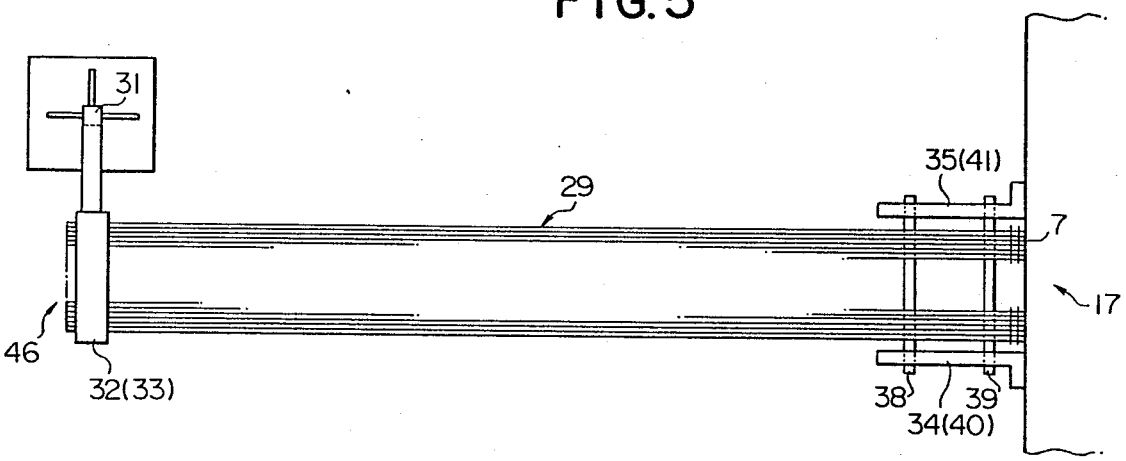
FIG. 5 is a top plan view showing a heddle supporting rack of the heddle transferring apparatus according to the present invention.
Figure 6:
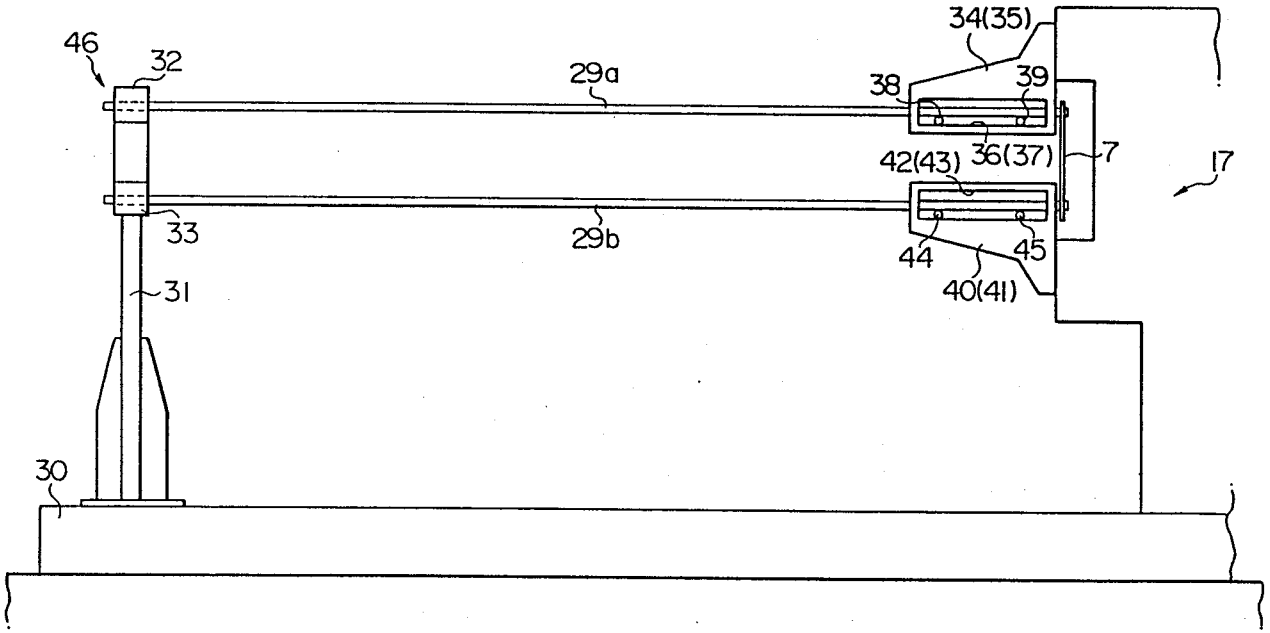
FIG. 6 is a front elevational view of the heddle supporting rack shown in FIG. 5.

A plurality of heddle bars 29 consisting of upper and lower heddle bars 29*a* and 29*b* are disposed in spaced and opposed relationship to the heddle magazine 1. As shown in FIGS. 5 and 6, the left ends of the upper heddle bars 29*a* and lower heddle bars 29*b* are supported through upper and lower brackets 32 and 33 on a vertical stand 31 which is mounted on a common base 30 of the frame member 17. On the frame member 17 are mounted a pair of upper parallel brackets 34 and 35 projecting parallel to the upper heddle bars 29*a* so as to interpose the heddle bars 29*a* therebetween. The upper parallel brackets 34 and 35 are respectively formed with rectangular supporting bores 36 and 37. The right end portions of the upper heddle bars 29*a* are supported on a pair of parallel supporting bars 38 and 39 which in turn are supported through the rectangular bores 36 and 37 by the upper brackets 34 and 35. Likewise, a pair of lower parallel brackets 40 and 41 projecting parallel to the lower heddle bars 29*b* are mounted on the frame member 17 so as to interpose the heddle bars 29*b* therebetween. The lower brackets 40 and 41 are respectively formed with rectangular supporting bores 42 and 43. The right end portions of the lower heddle bars 29*b* are supported on a pair of parallel supporting bars 44 and 45 which in turn are supported through the rectangular bores 42 and 43 by the lower brackets 40 and 41. As shown in FIG. 5, the heddle bars 29 consisting upper and lower heddle bars 29*a* and 29*b* are laterally disposed along the front surface of the frame member 17, and a plurality of the heddles 7 each having a warp thread passed therethrough are inserted and supported on the upper and lower heddle bars 29*a* and 29*b*. The aforesaid stand 31, upper brackets 34, 35, lower brackets 40, 41 and supporting bars 38, 39, 44, 45 as a whole constitute a heddle bar supporting rack 46.

In FIG. 4, reference numerals 47, 48 and 49 designate a pair of upper and lower heddle transferring chucks, a pair of upper and lower heddle receiving hooks, and a pair of upper and lower heddle retaining bars, respectively. Reference numerals 50 and 51 designate a pair of upper and lower heddle pushing bars and a pair of upper and lower prevention plates, respectively. The upper heddle transferring chuck 47, upper heddle receiving hook 48, upper heddle retaining bar 49, upper heddle pushing bar 50 and upper prevention plate 51 will hereinafter be described as the upper and lower portions of each of the aforesaid mechanisms are substantially identical in construction and operation with each other.

Figure 7:
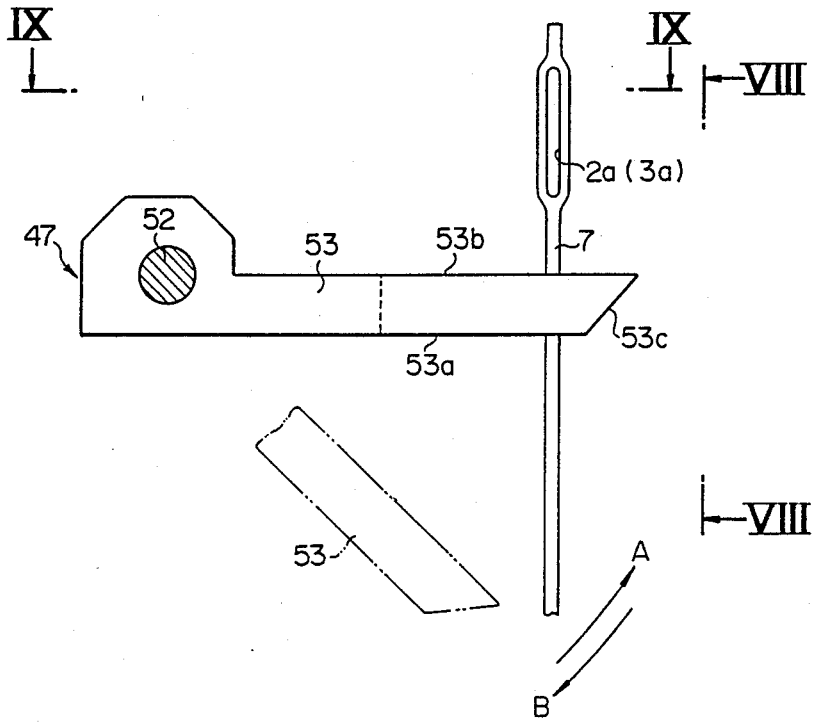
FIG. 7 is an enlarged schematic view showing a heddle transferring chuck of the heddle transferring apparatus according to the present invention.
Figure 8:
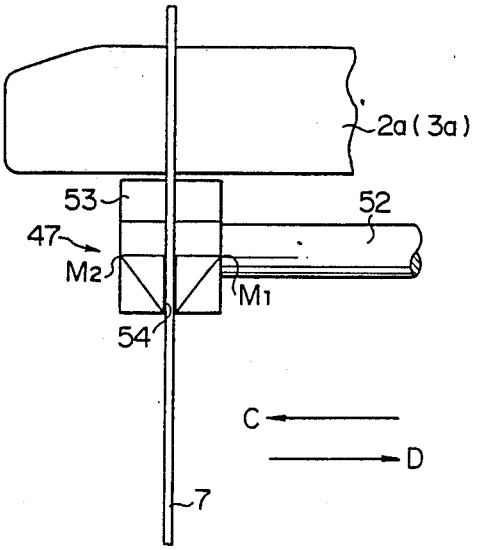
FIG. 8 is a side view of the heddle transferring chuck in FIG. 7 taken substantially along the line VIII—VIII of FIG. 7.
Figure 9:
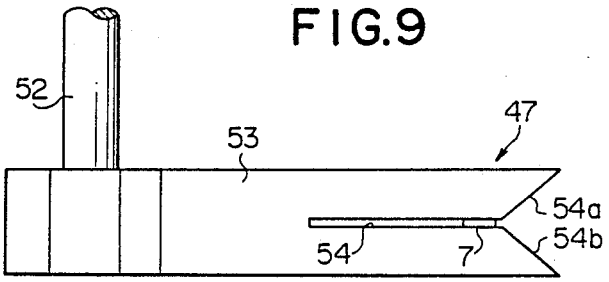
FIG. 9 is a top plan view of the heddle transferring chuck in FIG. 7 taken substantially along the line IX—IX of FIG. 7.

FIGS. 7, 8 and 9 schematically illustrate the construction of the upper heddle transferring chuck 47. In FIGS. 7, 8 and 9, the upper heddle transferring chuck 47 comprises a drive spindle 52 freely rotatably supported at its right end portion on the frame member 17, and a chuck portion 53 mounted on the left end portion of the drive spindle 52. As shown in FIG. 9, the chuck portion 53 is formed with a slit 54 extending perpendicularly to an axis of the chuck spindle 52 and inclined surfaces 54*a* and 54*b* for receiving the heddle 7 therein. The chuck portion 53 is further formed with an upper surface 53*b*, a lower surface 53*a* and an inclined surface 53*c* between the upper and lower surfaces 53*b* and 53*a*, as shown in FIG. 7. The upper surface 53*b*, inclined surface 53*c* and inclined surface 54*a* are intersected at a point $M_1$ with one another, while the upper surface 53*b*, the inclined 53*c* and inclined surface 54*b* are intersected at a point $M_2$ with one another. The drive spindle 52 is connected at its right end portion to suitable drive means so that the chuck portion 53 mounted on the chuck spindle 52 can be rotated about the axis of the spindle 52 in directions A and B shown in FIG. 7 and further reciprocated in directions C and D shown in FIG. 8. After a warp thread is drawn through the eye 8 of the heddle 7 maintained in the position $X_1$—$X_1$ of FIG. 4, the chuck portion 53 is rotated in the direction A from a position shown by broken lines in FIG. 7, and the heddle 7 is inserted through the inclined surfaces 54*a* and 54*b* into the slit 54 and retained by the upper heddle transferring chuck 47. Thereafter, the upper heddle transferring chuck 47 advances in the direction C of FIG. 8 to separate the heddle 7 from the first or second magazine bars 2*a* or 3*a*, and transfers to the heddle-receiving position $X_2$—$X_2$ of FIG. 4 from the warp-threading position $X_1$—$X_1$ of FIG. 4.

Figure 10:
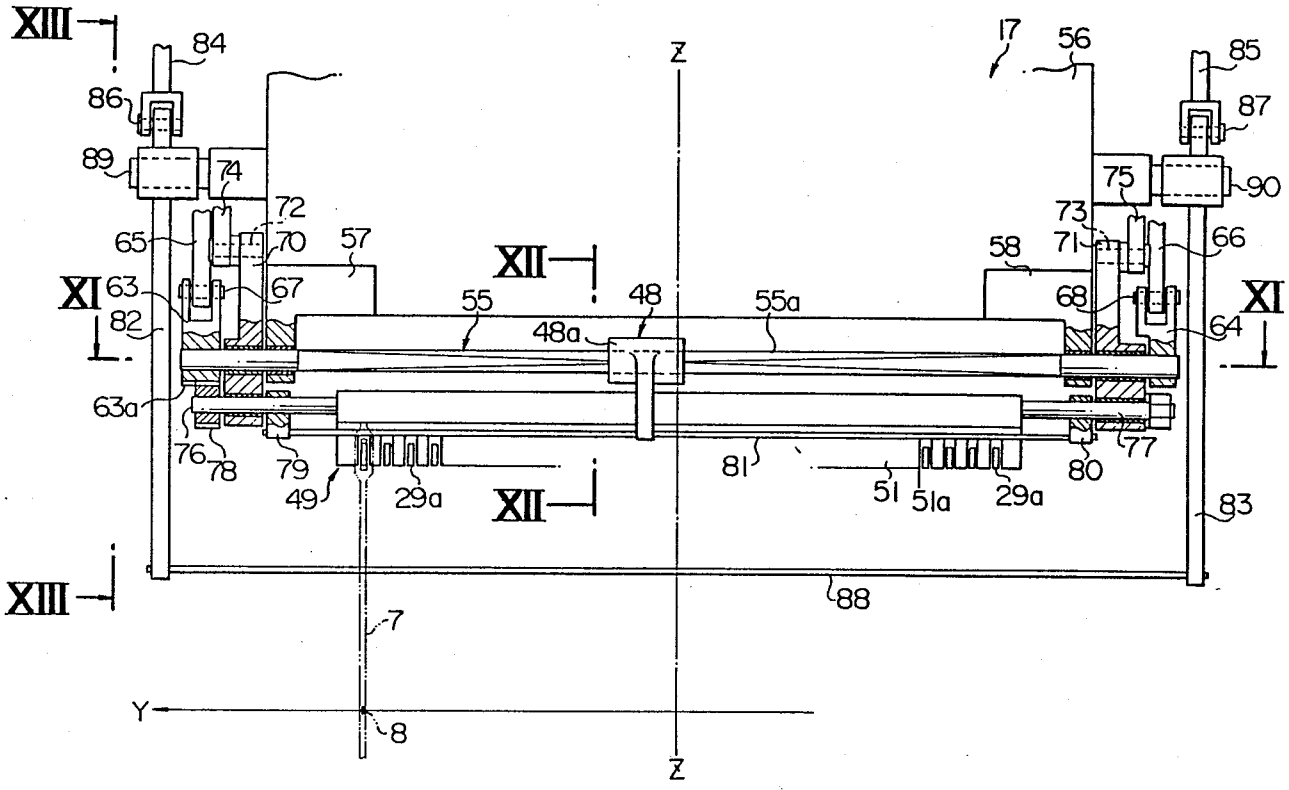
FIG. 10 is a front view, partly broken away, of the upper heddle receiving hook, the prevention plate and the heddle pushing bar in FIG. 4 taken substantially along the line X—X of FIG. 4.
Figure 11:
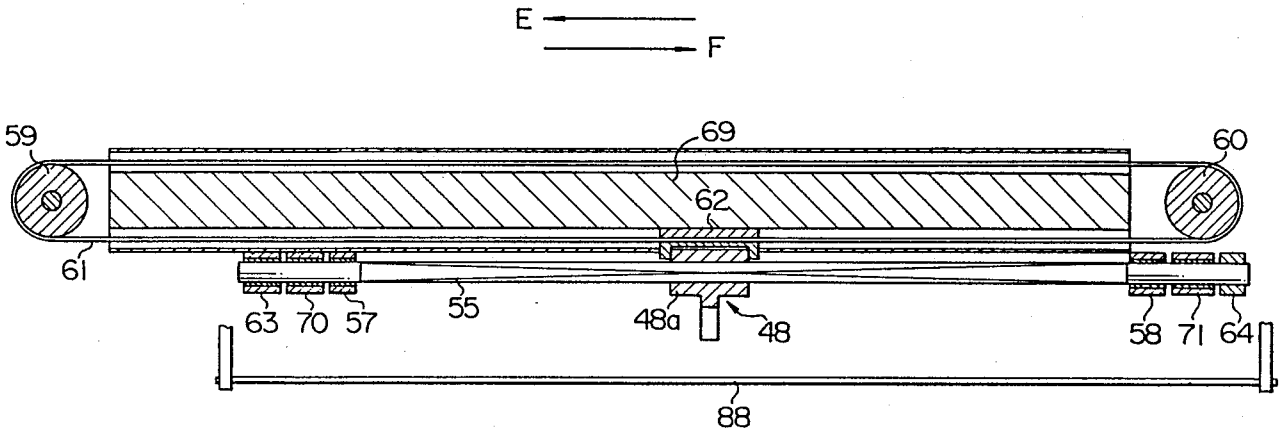
FIG. 11 is a sectional view, taken substantially along the line XI—XI of FIG. 10, showing a timing belt which is adapted to move the heddle receiving hook in a warp-threading direction.
Figure 12:
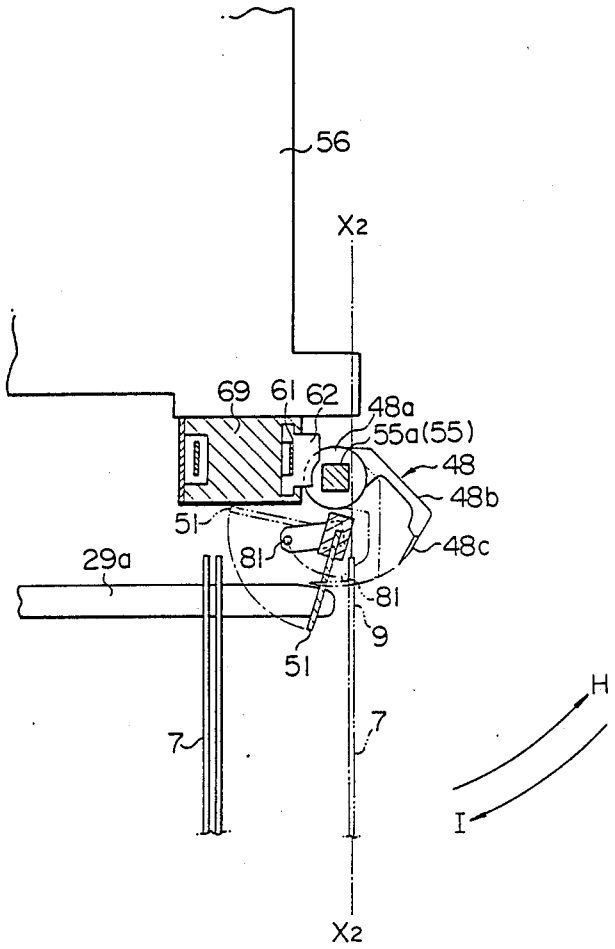
FIG. 12 is a sectional view taken substantially along the line XII—XII of FIG. 10.

In FIG. 10, reference numeral 55 denotes a spindle which is freely rotatably supported by a pair of brackets 57 and 58 mounted on a casing 56 of the frame member 17 and which extends parallel to a warp-threading direction Y in which the warp thread is drawn through the eye 8 of the heddle 7. The spindle 55 has between the brackets 57 and 58 a supporting portion 55*a* having a square cross section. The supporting portion 55*a* of the spindle 55 passes through the heddle receiving hook 48 and has the heddle receiving hook 48 slidably supported thereon. The heddle receiving hook 48, as shown in FIG. 12, comprises a boss portion 48*a* slidably supported on the supporting portion 55*a* of the spindle 55, an arm portion 48*b* mounted on the boss portion 48*a*, and a claw portion 48*c* which projects from the arm portion 48*b* and which is to be inserted into the guide aperture 9 of the heddle 7. In FIG. 11, reference numerals 59 and 60 designate a pair of pulleys which are provided at the vicinity of the opposite ends of the spindle 55 and which have a timing belt 61 extending between the pulleys 59 and 60. The timing belt 61 has mounted thereon an engagement member 62 which is connected to the boss portion 48*a* of the heddle receiving hook 48. The engagement member 62 is caused to move in opposite directions E and F shown in FIG. 11, when the pulleys 59 and 60 are driven to rotate about the axes thereof by suitable drive means. The movement of the engagement member 62 causes the heddle receiving hook 48 to move on along the spindle 55 in the warp-threading direction Y shown in FIG. 10. The pulleys 59 and 60 are driven in accordance with a predetermined program by a microcomputer so that the heddle receiving hook 48 can be moved to the extension line of any one of a plurality of heddle bars 29. The opposite ends of the spindle 55 extending outwardly of the brackets 57 and 58 are fixedly connected to a pair of arms 63 and 64 which in turn are connected through pins 67 and 68 to a pair of first links 65 and 66, respectively. The first links 65 and 66 are connected to suitable drive means (not shown) provided in the casing 56 so that the spindle 55 can be rotated about its own axis through the arms 63 and 64. The rotation of the spindle 55 causes the heddle receiving hook 48 to rotate about the spindle 55. As a result of the rotation of the heddle receiving hook 48, the claw portion 48*c* of the heddle receiving hook 48 is inserted, as shown by broken lines in FIG. 12, into the guide aperture 9 of the heddle 7 which has been transferred to the heddle-receiving position $X_2$—$X_2$. At the same time, the chuck portion 53 of FIG. 7 is rotated in the direction B from the position shown by solid lines in FIG. 7 to the position shown by broken lines in FIG. 7 so that the heddle receiving hook 48 can receive the heddle 7 thereon. In FIG. 11, reference numeral 69 is a guide member which is disposed between the pulleys 59 and 60 and which is adapted to guide the timing belt 61 and the engagement member 62.

In FIG. 10, a pair of levers 70 and 71 are respectively provided between the arm 63 and the bracket 57, and between the arm 64 and the bracket 58. The central portion of the lever 70 is freely rotatably supported on one end portion of the spindle 55, while the central portion of the lever 71 is freely rotatably supported on the other end portion of the spindle 55. The lever 70 is connected at one end thereof to one link 74 of a pair of second links 74 and 75 through a pin 72, and is freely rotatably supported at the other end thereof on a journal 76. Likewise, the lever 71 is connected at one end thereof to the other link 75 through a pin 73, and is freely rotatably supported at the other end thereof on a journal 77. The journal 76 is formed with a small gear 78 and has an arm 79 fixedly mounted thereon so as to interpose the lever 70 between the small gear 78 and the arm 79, while the journal 77 has fixedly mounted thereon an arm 80 which is disposed adjacent the bracket 58. The small gear 78 of the journal 76 meshes with a gear 63*a* which is formed in the arm 63 coaxially of the spindle 55, as clearly seen from FIG. 13. A retaining bar 81 is supported at its opposite ends by the arms 79 and 80 and extends parallel to the warp-threading direction Y and is disposed in opposed relationship to the heddle receiving hook 48. The arms 79, 80 and retaining bar 81 as a whole constitute the aforesaid heddle retaining bar 49. The aforesaid prevention plate 51 is provided between the journals 76 and 77 and fixedly mounted at its opposite ends on the journals 76 and 77. The prevention plate 51 is disposed parallel to the warp-threading direction Y and in opposed relationship to the heddle receiving hook 48, and is freely rotatably supported through the journals 76 and 77 by the levers 70 and 71. The prevention plate 51 is formed at its lower portion in FIG. 10 with a plurality of slits 51*a* into which the heddle bars 29*a* are inserted. If the levers 70 and 71 are rotated through the second links 74 and 75 by suitable drive means (not shown), the prevention plate 51 and the retaining bar 81 are rotated about the axis of the spindle 55 in directions H and I shown in FIG. 12, i.e., along a vertical plane perpendicular to the warp-threading direction Y of FIG. 10. If the spindle 55 is rotated about the axis thereof through the first links 65, 66 and arms 63, 64 by the drive means (not shown), and if the heddle receiving hook 48 is rotated to the position shown by broken lines in FIG. 12 to insert the claw portion 48c into the guide aperture 9 of the heddle 7, the prevention plate 51 and the retaining bar 81 are rotated about the spindle 55 through the levers 70, 71 and the second links 74, 75. Thereafter, the prevention plate 51 is returned to the position shown by solid lines in FIG. 12 from the position shown by broken lines in FIG. 12, and the retaining bar 81 is rotated to the position shown by broken lines in FIG. 12 from the position shown by solid lines in FIG. 12. As a result, the heddle prevention plate 51 prevents the heddle 7 already inserted on the heddle bar 29a from being removed from the heddle bar 29a, and at the same time the retaining bar 81 is brought into engagement with the heddle 7 into which the claw portion 48c of the heddle receiving hook 48 is inserted, and retains the heddle 7 in cooperation with the heddle receiving hook 48. When this occurring, since the prevention plate 51 and the arm 79 having the supporting bar 80 supported thereon are respectively fixedly mounted on the journal 76 and since the small gear 78 on the journal 76 is held in meshing engagement with the gear 63a of the arm 63, the journal 76 is rotated in a direction G shown in FIG. 13 and promotes the movement of the prevention plate 51 and retaining bar 81, if the journal 76 rotates about the axis of the spindle 55 in the direction H shown in FIG. 12.

In FIG. 10, reference numeral 82 designates a lever which is connected at one end thereof to a third link 84 through a pin 86 and at the other end thereof to one end of a heddle pushing bar 88, and reference numeral 83 designates a lever which is connected at one end thereof to a third link 85 through a pin 87 and at the other end thereof to the other end of the heddle pushing bar 88. The heddle pushing bar 88 is disposed parallel to the warp-threading direction Y and in opposed relationship to the heddle receiving hook 48. The lever 82 is freely rotatably supported between the pin 86 and the heddle pushing bar 88 on a supporting pin 89 which is mounted on the casing 56. Likewise, the lever 83 is freely rotatably supported between the pin 87 and the heddle pushing bar 88 on a supporting pin 90 which is disposed on the common axis of the supporting pin 89 and which is mounted on the casing 56. If the third links 84 and 85 are driven by suitable drive means (not shown), the heddle pushing bar 88 rotates about the supporting pins 89 and 90 in opposite directions J and K shown in FIG. 13, i.e., along the aforesaid vertical plane Z—Z. And, if the levers 82 and 83 rotate about the supporting pins 89 and 90, respectively, and accordingly the heddle pushing bar 88 is rotated in the direction K from the position shown by solid lines in FIG. 13, the levers 70 and 71 are rotated by the drive means (not shown) through the second links 74 and 75. When this occurring, the prevention plate 51 is rotated to the position shown by broken lines in FIG. 12 fom the position shown by solid lines in FIG. 12 and thus is moved away from the heddle bar 29a, and also the retaining bar 81 is rotated to the position shown by solid lines in FIG. 12 from the position shown by broken lines in FIG. 12 and thus is moved away from the heddle 7 held in the position $X_2$—$X_2$. At this time, these movements are promoted by the small gear 78 meshing with the gear 63a of the arm 63. Furthermore, the heddle pushing bar 88 is rotated in the direction K of FIG. 13 to the position shown by broken lines from the position shown by solid lines. The movement of the heddle pushing bar 88 causes the heddle 7 received on the heddle receiving hook 48 and held in the position $X_2$—$X_2$ to be inserted on the heddle bar 29a. Thus, the heddle pushing bar 88 is adapted to push and transfer the heddle 7 to the heddle bar 29a from the heddle receiving hook 48. The levers 82, 83 and heddle pushing bar 88 as a whole constitute the aforesaid heddle pushing bar 50. It is noted that the drive means (not shown) for driving the first links 65 and 66, drive means (not shown) for driving the second links 74 and 75 and drive means (not shown) for driving the third links 84 and 85 are connected within the casing 56 with one another and constructed such that the heddle receiving hook 48, prevention plate 51, retaining bar 81 and heddle pushing bar 88 are operated in the recited order by a single source of drive.

The operation of the heddle transferring apparatus constructed as described above will hereinafter be described in detail.

As previously indicated, the upper and lower portions of each of the heddle transferring chucks 47, heddle receiving hooks 48, heddle retaining bars 49, heddle pushing bars 50 and prevention plates 51 are substantially in construction and operation with each other, and therefore the upper heddle transferring chuck 47, upper heddle receiving hook 48, upper heddle retaining bar 49, upper heddle pushing bar 50 and upper prevention plate 51 will be mainly described.

In FIG. 4, the first and second heddle groups 11 and 12 supported on the heddle magazine 1 are advanced toward the warp-threading position $X_1$—$X_1$ by the heddle advancing members 20, 21 and 22, 23, respectively. A heddle 7 is separated selectively from the first or second heddle group 11 or 12 by the heddle removing mechanism 26. The separated heddle 7 is advanced along the first heddle magazine bars 2a, 2b or second heddle magazine bars 3a, 3b, and is maintained in the warp-threading position $X_1$—$X_1$ by the upper heddle positioning means 27 and the lower heddle positioning means 28. In the position $X_1$—$X_1$, a warp thread is drawn through the eye 8 of the heddle 7 by the warp-threading apparatus (not shown).

Figure 13:
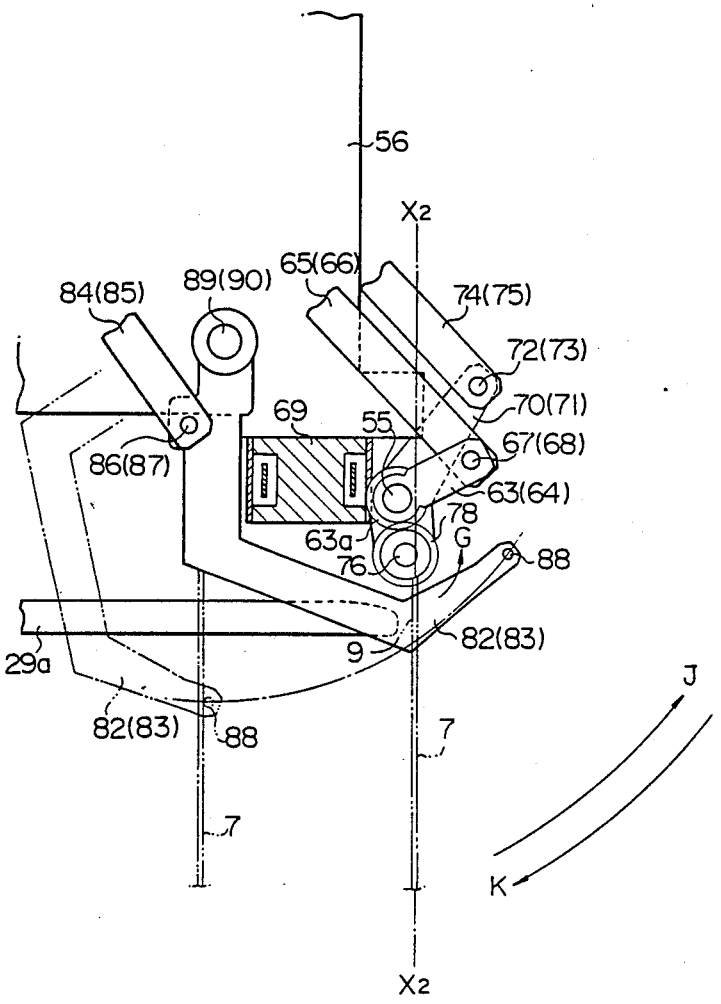
FIG. 13 is a side view taken substantially along the line XIII—XIII of FIG. 10.

Thereafter, the heddle transferring chuck 47 is rotated through the spindle 52 in the direction A in FIG. 7 by the drive means (not shown) until the heddle 7 is inserted into the slit 54 of the chuck portion 53. The chuck portion 53 with the heddle 7 received in the slit 54 moves in the direction C in FIG. 8, and as a result, the heddle 7 is removed from the first magazine bar 2a or second magazine bar 3a and transferred to the receiving position $X_2$—$X_2$ from the warp-threading position $X_1$—$X_1$. At this time, the first links 65 and 66 in FIG. 13 are driven by the drive means (not shown), and therefore the heddle receiving hook 48 is rotated as shown by broken lines in FIG. 4 and FIG. 12, so that the claw portion 48c of the heddle receiving hook 48 is inserted into the guide aperture 9 of the heddle 7. At the same time, the chuck portion 53 is rotated away from the heddle 7 in the direction B in FIG. 7. Thereafter, if the second links 74 and 75 are driven by the drive means (not shown), the levers 70 and 71 are rotated in the direction K in FIG. 13 and the prevention plate 51 is rotated to the position shown by broken lines in FIG. 12 from the position shown by solid lines in FIG. 12. As a result, the heddle bar 29a is inserted into the slit 51a of the prevention plate 51, and the heddle prevention plate 51 prevents the heddle 7 already inserted on the heddle bar 29a from being removed from the heddle bar 29a. Also, the retaining bar 81 is rotated to the position shown by broken lines from the position shown by solid lines, and retains the heddle 7 in cooperation with the heddle receiving hook 48.

With the heddle 7 supported by a pair of the upper and lower heddle receiving hooks 48 and retained between these heddle receiving hooks 48 and the retaining bar 81, the pulleys 59 and 60 of FIG. 11 are driven by the drive means (not shown), and the heddle receiving hook 48 is moved along the retaining bar 81 and stopped on the extension line of a predetermined heddle bar 29a. Thereafter, the third links 84 and 85 are driven by the drive means (not shown) and the lever 88 is rotated in the direction K in FIG. 13 from the position shown by solid lines. As a result, the heddle 7, which is supported by the heddle receiving hook 48 and held at the position $X_2$—$X_2$ on the extension line of the predetermined heddle bar 29a, is pressed by the heddle pushing bar 88 and inserted through the guide aperture 8 thereof on the heddle bar 29a. At this time, the levers 70 and 71 are rotated by the drive means (not shown), so that the prevention plate 51 is rotated to the position shown by broken lines in FIG. 12 from the position shown by solid lines in FIG. 12 and at the same time the retaining bar 81 is rotated to the position shown by solid lines from the position shown by broken lines. Thereafter, the heddle pushing bar 88 is further rotated into the position shown by broken lines in FIG. 13 and thereby completes the insertion of the heddle 7 on the heddle bar 29a. Likewise, the heddle 7 is inserted on the heddle bar 29b, and the insertion of the heddle 7 on the predetermined upper and lower heddle bars 29a and 29b is completed. After the insertion of the heddle 7 is completed by the heddle pushing bar 88, the first links 65 and 66 are driven again by the drive means (not shown) so that the heddle receiving hook 48 is returned to the initial position thereof through the pins 67, 68 and arms 63, 64. At the same time, the third links 84 and 85 are driven by the drive means (not shown), and the heddle pushing bar 88 is returned to the initial position thereof. As previously indicated, the movement of the prevention plate 51 and retaining bar 81 is promoted as the small gear 78 is held in meshing engagement with the gear 63a of the arm 63.

From the foregoing description, it will be seen that in accordance with the present invention, there is provided an improved heddle transferring apparatus which overcomes all of the drawbacks of the aforementioned conventional heddle transferring apparatuses.

While a certain representative embodiment and details have been shown for the purpose of illustrating the invention, it will be apparent to those skilled in this art that various changes and modifications may be made therein without departing from the scope of the invention.

What we claim is:

1. A heddle transferring apparatus comprising:

a heddle magazine having upper and lower magazine bars which have a plurality of heddles supported thereon;

a heddle bar supporting rack disposed in spaced and opposed relationship to said heddle magazine and having supported thereon a plurality of upper heddle bars in opposed relationship to said upper magazine bar and a plurality of lower heddle bars in opposed relationship to said lower magazine bar;

means for separating one heddle from among said plurality of heddles and maintaining said separated heddle in a first predetermined position wherein a warp thread is passed through the heddle;

a pair of upper and lower heddle transferring chucks for transferring to a second predetermined position said heddle maintained in said first predetermined position;

a pair of upper and lower heddle receiving hooks for receiving said heddle transferred to said second predetermined position from said pair of heddle transferring chucks, each of said heddle receiving hooks being movable in a direction parallel to a warp-threading direction wherein a warp thread is passed through the heddle so as to be selectively stopped on an extension line of predetermined upper and lower heddle bars of said upper and lower heddle bars;

a pair of upper and lower heddle retaining bars for retaining said heddle of said second predetermined position in cooperation with said heddle receiving hooks, each of said heddle retaining bars being disposed parallel to said warp-threading direction and in opposed relationship to the corresponding heddle receiving hook and being movable along a vertical plane perpendicular to said warp-threading direction; and a pair of upper and lower heddle pushing bars each disposed parallel to said warp-threading direction and in opposed relationship to the corresponding heddle receiving hook and each movable along said vertical plane perpendicular to said warp-threading direction so that the heddle received on said heddle receiving hooks is inserted on said predetermined upper and lower heddle bars.

2. A heddle transferring apparatus as set forth in claim 1, which further comprises a pair of upper and lower prevention plates each disposed parallel to said warp-threading direction and in opposed relationship to the corresponding heddle receiving hook and each formed with a plurality of slits into which the corresponding heddle bars are inserted, each of said prevention plates being movable along said vertical plane perpendicular to said warp-threading direction so that, when said corresponding heddle bars are inserted into said slits, the prevention plate is moved away from said heddle bars, and so that, after said heddle received on said heddle receiving hooks is inserted on said predetermined upper and lower heddle bars, said prevention plate is returned to its initial position to prevent the inserted heddle from being removed from said heddle bars.

* * * * *